US008016477B2

(12) United States Patent
Oswald

(10) Patent No.: US 8,016,477 B2
(45) Date of Patent: Sep. 13, 2011

(54) ROTARY THROTTLE ASSEMBLY FOR OPERATING A POWER UNIT IN TWO POWER SETTINGS

(76) Inventor: Fred Oswald, Sands Point, NY (US)

( * ) Notice: Subject to any disclaimer, the term of this patent is extended or adjusted under 35 U.S.C. 154(b) by 1124 days.

(21) Appl. No.: 11/697,614

(22) Filed: Apr. 6, 2007

(65) Prior Publication Data

US 2007/0259720 A1 Nov. 8, 2007

Related U.S. Application Data

(60) Provisional application No. 60/797,721, filed on May 4, 2006.

(51) Int. Cl.
*B01F 11/00* (2006.01)

(52) U.S. Cl. ..... 366/117

(58) Field of Classification Search ..... 366/117
See application file for complete search history.

(56) References Cited

U.S. PATENT DOCUMENTS 3,964,456 A * 6/1976 Eshelman ..... 123/406.75
5,829,874 A * 11/1998 Breeding ..... 366/120
2005/0266742 A1* 12/2005 Kojima ..... 440/53

* cited by examiner

*Primary Examiner* — Walter D Griffin
*Assistant Examiner* — Christopher K VanDeusen
(74) *Attorney, Agent, or Firm* — Gerald T. Bodner

(57) ABSTRACT

A rotary throttle assembly is disclosed for operating a power unit such as an engine or a motor in either a first power setting or a second power setting. The rotary throttle assembly may be used in a concrete vibrator to operate the vibrator in either an idle power setting or a desired power setting. The throttle assembly includes a rotatable throttle handle, a linkage mechanism contained in a casing, and means for urging the throttle assembly selectively to adopt a first position or a second position.

5 Claims, 4 Drawing Sheets

ROTARY THROTTLE ASSEMBLY FOR OPERATING A POWER UNIT IN TWO POWER SETTINGS

This application claims the benefit of U.S. Provisional Patent Application No. 60/797,721, filed May 4, 2006.

FIELD OF THE INVENTION

The invention relates to a rotary throttle assembly including a rotatable throttle handle and a linkage mechanism contained in a casing for operating a power unit such as an engine or motor in two power settings.

The invention further relates to methods of operating portable wet concrete vibrators.

BACKGROUND AND PRIOR ART

If wet concrete is placed into a form for walls, columns, etc., and the wet concrete is left to harden as placed, the resulting concrete will be left with holes from air pockets or "air voids". To insure that the concrete is consolidated without "air voids", a vibrator, which sends out shock waves to push lighter trapped air up and out of the wet concrete, is used.

The vibrator generally consists of three parts: the head, flexible shaft, and power unit. The head typically consists of a tube which is sealed in the front with ball bearing and an eccentric inside driven by a flexible shaft. The flexible shaft and the attached vibrator head are driven by the power unit, which is typically an electric motor or gasoline engine. To vibrate the wet concrete, the head and shaft of the vibrator are lowered into the concrete mixture. The speed of rotation required for good consolidation is typically from 10,000 rpm to 12,000 rpm.

In the case of gasoline engine driven vibrators, the throttle setting determines the speed. Most throttles for operating engine driven vibrators are of the linkage-type, and include a pivoting lever which controls the engine through a cable. In known linkage-type throttles, the pivoting lever pulls the cable, which in turn linearly opens the throttle. To close the throttle, the pivoting lever loosens the cable, which in turn linearly closes the throttle. Typically, the lever, the pivot, and the cable are exposed.

During the consolidating (vibrating) operation, the wet concrete can splatter, and consequently, the operator's hands, which are usually both on the flexible shaft to hold and guide the vibrator (see FIG. 6), are covered with wet concrete. When the operator controls the throttle, the wet concrete on the operator's hands then gets deposited on the linkage-type throttle. If the wet concrete on the linkage-type throttle is not washed off at the end of the day, it will solidify and the resulting hardened concrete can inhibit the operation of the throttle and in particular, the hardened concrete can prevent the throttle lever from moving to the desired power setting (for example, 10,000 rpm-12,000 rpm required for good consolidation of concrete). This results in poorly consolidated concrete.

Furthermore, the linkage-type throttle allows the operator full control of the throttle and does not prevent the operator from operating at below the minimum speed of rotation (10,000 rpm) required for good consolidation. Thus, the operator may operate at below the desired power setting either unintentionally, or for personal reasons such as to lower the noise level.

SUMMARY OF THE INVENTION

The invention provides a rotatable throttle assembly in which most of the moving parts are enclosed.

The invention enables an engine to be operated hands-free in two desired power settings.

The invention provides a method of operating wet concrete vibrator by rotating a rotary throttle assembly.

DETAILED DESCRIPTION

Reference is now made to FIGS. 1-4 which show a preferred embodiment of the invention.

Figure 1:
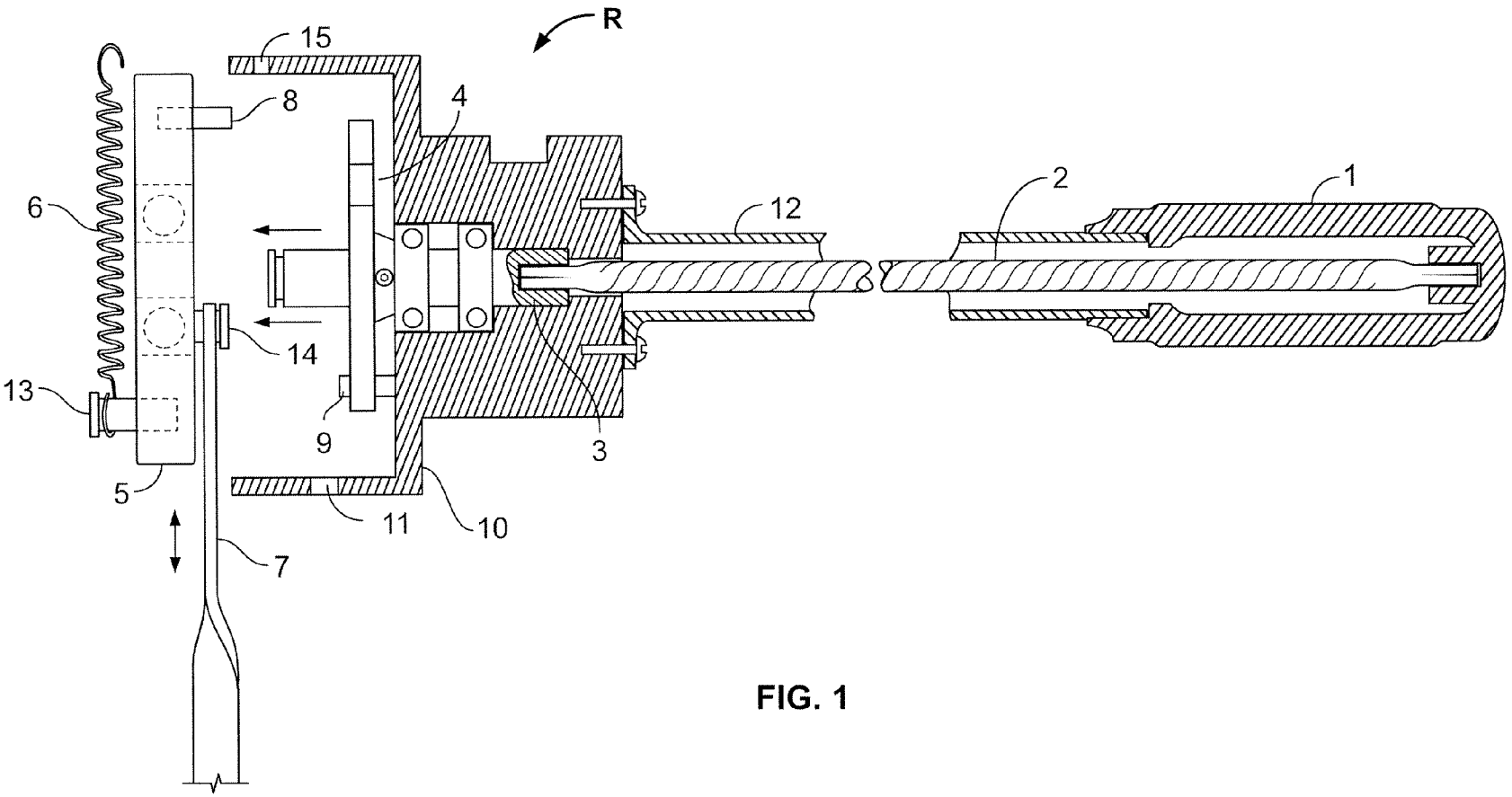
FIG. 1 is an exploded view of a preferred embodiment of the invention.
Figure 5:
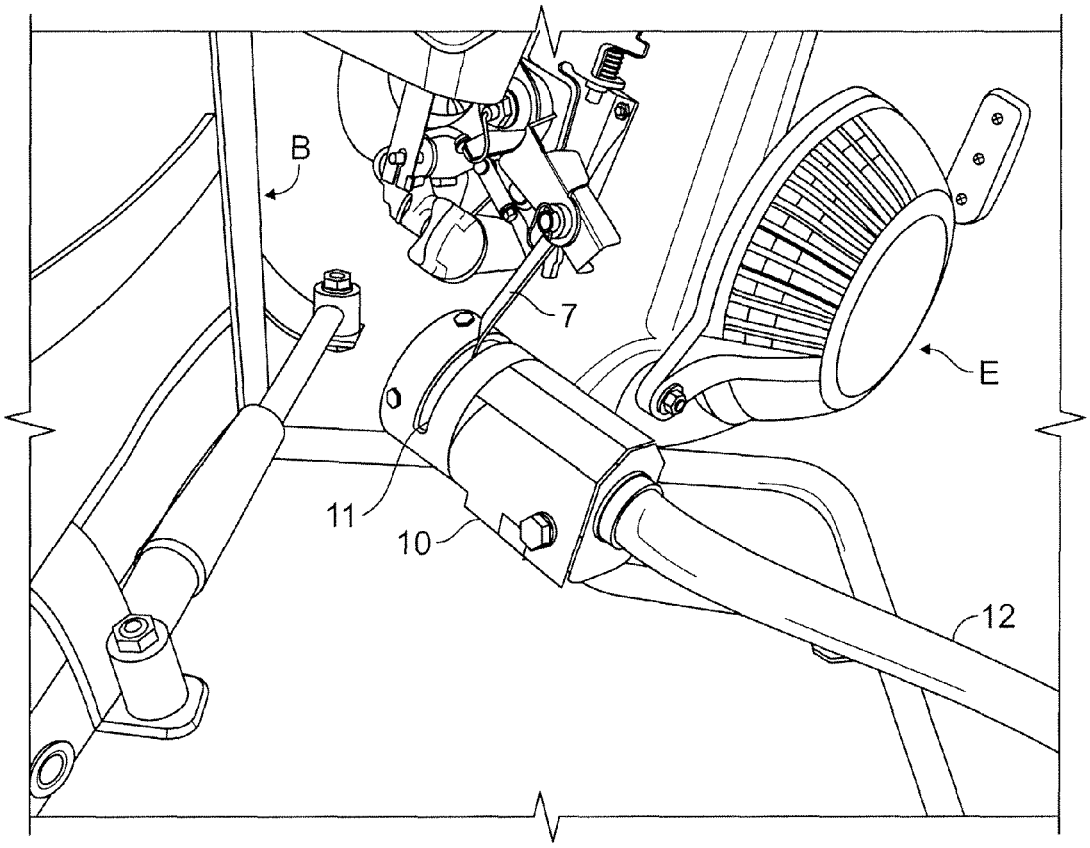
FIG. 5 shows the rotary throttle assembly connected to a portable motor.

FIG. 1 shows the parts of a rotary throttle (R) according to the invention. Handle (1) which is rotatable about an axis, is connected to a flexible shaft (2). Any rotation of the handle (1) is transmitted through the flexible shaft (2) to a drive shaft (3), which in turn rotates a driving disk (4). The driving disk (4) has cam faces which engage a driven pin (8) secured to a driven disk (5). A spring (6) is secured to the driven disk (5) at one end by a screw (13), and it is secured to a wall (15) of a casing (10) of the rotary throttle assembly at the other end. In a preferred embodiment, the spring is secured to the driven disk (5) opposite the driven pin (8). A throttle linkage (7), which is connected to the throttle of an engine (E) at one end as shown in FIG. 5, is also secured to the driven disk (5) by a screw (14) at the other end. In a preferred embodiment, the throttle linkage is secured to the driven disk (5) at approximately 90 degrees from the spring or the driven pin (8). A stop pin (9) is secured to the casing (10).

Figure 2:
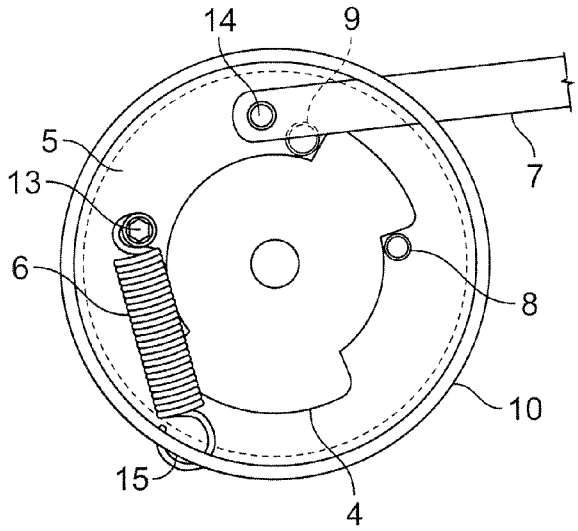
FIG. 2 shows the rotary throttle in a first position.
Figure 3:
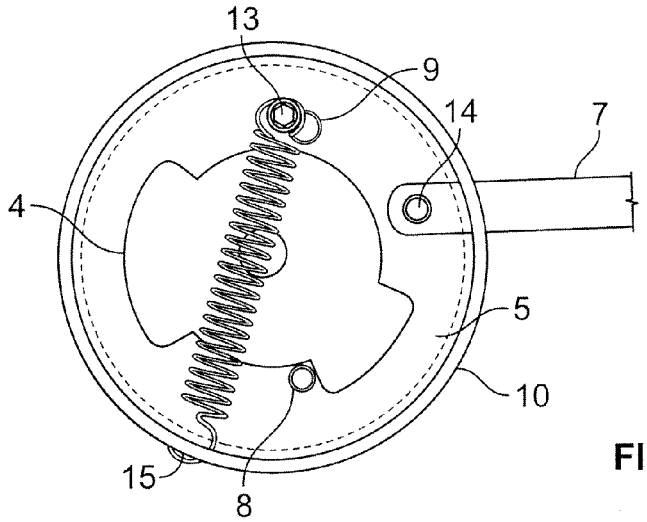
FIG. 3 shows the rotary throttle of FIG. 2 rotated clockwise to a position in which the driven disk is at a top dead center position.
Figure 4:
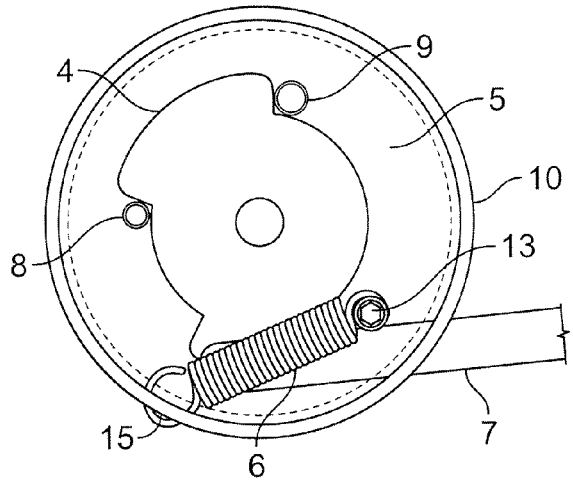
FIG. 4 shows the rotary throttle of FIG. 3 further rotated clockwise to a second position.

The operation of the rotary throttle assembly will now be described with reference to FIGS. 2-4. For illustrative purposes, the driven plate (5) is shown in FIGS. 2-4 as a transparent plate to show the configuration and relationship of the relevant parts In a first position shown in FIG. 2, the spring (6) exerts a tangential force in the counterclockwise direction on the driven pin (8), which in turn drives the driving disk (4) counterclockwise. However, the stop pin (9) on the casing (10) abuts the driving disk (4) and prevents the driving disk from rotating counterclockwise, which results in a first static position with a corresponding throttle linkage position, which may correspond to the "idle" or low power setting.

During operation, the operator may rotate the handle slightly clockwise which in turn rotates the drive shaft (3), the driving disk (4), the driven pin (8), the driven disk (5), and the throttle linkage clockwise. For this example, any clockwise movement of the throttle linkage translates to increasing power and higher rpm.

The operator may continue to rotate the handle slightly clockwise, and as soon as the handle is let go, the spring will rotate the driven disk (5) and the throttle linkage back to the first, idle position. This may be particularly useful after a cold start when the temperature is low to slightly rev the engine and warm up the engine.

As the operator continues to rotate the handle clockwise, the driving disk (4) will reach a "top dead center" position in which the spring (6) is stretched the furthest as shown in FIG. 3. In this position, a slight rotation of the driven disk (5) on which the spring is secured will cause the spring to contract and rotate in the sane direction.

If the operator continues to rotate the handle clockwise past the "top dead center" position, the spring (6) will exert a tangential force in the clockwise direction and move the driven pin (8) and the driving plate (4) clockwise until the driving plate abuts the stop pin (9), which prevents the assembly from rotating clockwise any further, resulting in the position shown in FIG. 4. In a preferred embodiment, this moves the throttle lever (7) to a desired operating position, which in the example of concrete vibrator, is the position in which the vibrator is vibrating at 10,000 to 12,000 rpm.

To return the throttle to the idle position, the operator simply operates the rotary throttle as described above in reverse (counterclockwise). Namely, the operator rotates the throttle handle (1) counterclockwise, which rotates the driving disk (4) in the same direction to engage the driven pin (8). This in turn rotates the driven disk (5) until the driven disk (5) reaches the top dead center position. Once the driven disk (5) rotates past the top dead center position in the counterclockwise direction, the spring (6) will contract and moves the lever (7) back to the idle position.

As shown in FIG. 5, the rotary throttle assembly may be enclosed by a casing (10). The casing (10) houses the drive shaft (3), the driving disk (4), the driven pin (8), the driven disk (5), the spring (6), the stop pin (9), and has an opening (11) through which the throttle linkage (7) extends and connects to the engine (E). The flexible shaft (2) is preferably enclosed inside a handle bar (12), which at one end connects to the casing (10), and at the other end connects to the handle (1).

Figure 6:
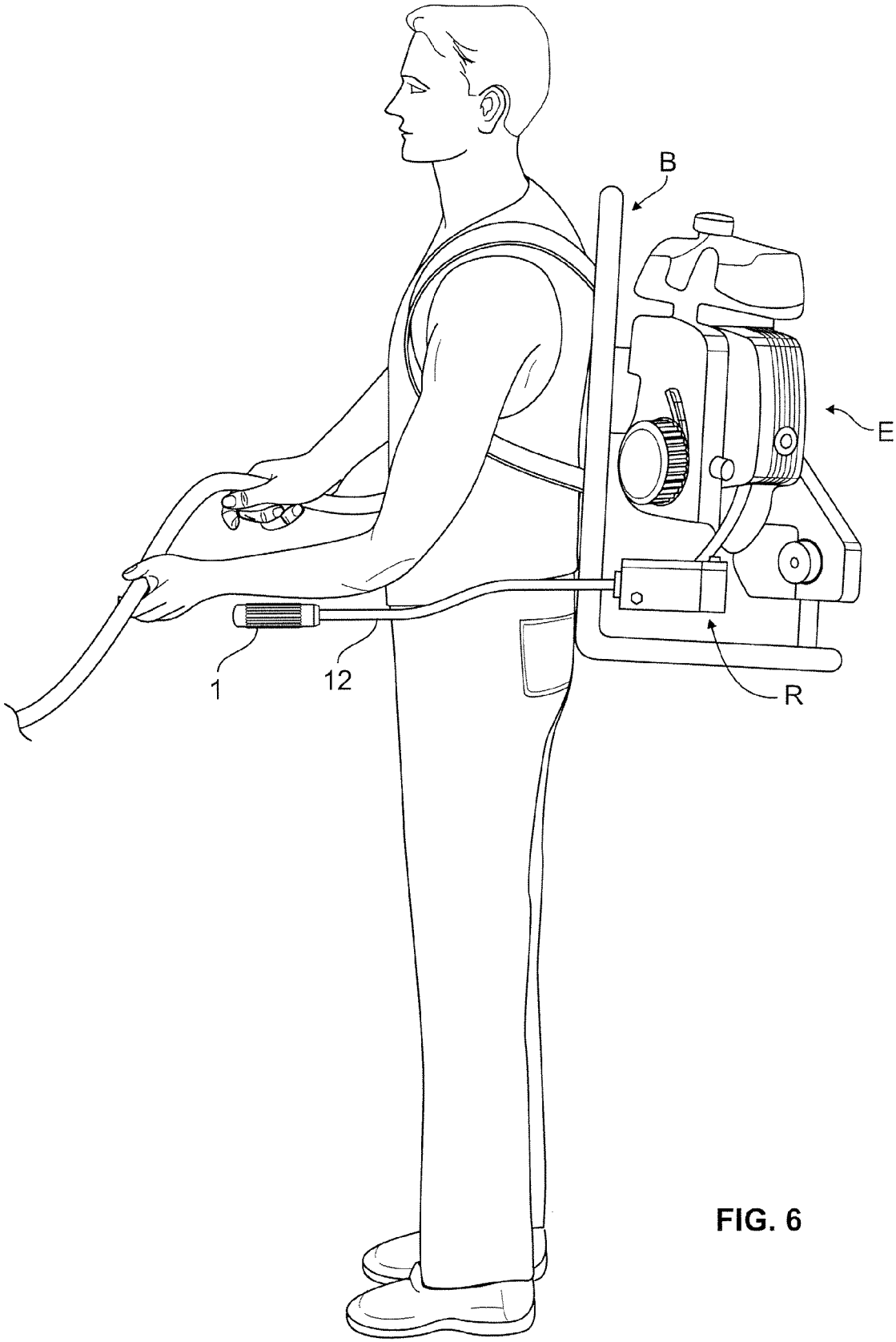
FIG. 6 shows an operator carrying a portable assembly for vibrating wet concrete with the rotary throttle of the invention.

In the preferred embodiment shown in FIG. 5, the engine (E) is a portable engine mounted to a backpack (B). The throttle assembly is positioned behind the back of the operator during operation, and is essentially shielded from any splattering wet concrete by the operator. Furthermore, as illustrated in FIG. 6, the only part of the rotary throttle assembly handled by the user during operation is the throttle handle (1). However, the throttle handle (1) can be readily cleaned and even if wet concrete is deposited thereon and left to set, would not affect the operation of the rotary throttle assembly. Other than the throttle handle (1), the rotary throttle assembly has essentially no disposed parts on which wet concrete can be deposited.

The foregoing describes a preferred embodiment in which the controlled engine is an internal combustion engine. However, an alternative power drive system is contemplated, such as an electric motor.

Furthermore, although the invention is disclosed with reference to particular embodiments thereof, it will become apparent to those skilled in the art that numerous modifications and variations can be made which will fall within the scope and spirit of the invention as defined by the attached claims. For example, although the operation of the rotary throttle assembly has been described with respect to a concrete vibrator, one skilled in the art will be able to utilize the rotary throttle assembly in many other applications where it is desirable to operate an engine in two power settings or in applications where it is important to ensure that an engine operates at a certain power.

I claim:

1. In a portable assembly for vibrating wet concrete, wherein the assembly includes a backpack containing a power unit which drives a flexible shaft having a vibrator head adapted for immersion in the wet concrete, the power unit having a throttle arm, the improvement comprising:

a rotatable throttle handle positioned for manual operation by a user wearing the backpack;

a casing; and a linkage mechanism contained in the casing, the linkage mechanism being connected to the rotatable throttle handle and the throttle arm of the power unit to set the power unit to one of a state of low speed operation and a state of high speed operation;

wherein the linkage mechanism includes:

a rotatable driven disk, the rotatable driven disk being rotatable in a first direction of rotation to a first stop position and in a second direction of rotation which is opposite the first direction of rotation to a second stop position, the rotatable driven disk being operatively coupled to the throttle arm of the power unit to move the throttle arm to a first position and to a second position, the power unit being in the state of low speed operation when the throttle arm is in the first position, the power unit being in the state of high speed operation when the throttle arm is in the second position, the rotatable driven disk having a driven pin mounted thereon;

a rotatable driving disk operatively coupled to the rotatable throttle handle and rotatable in response to rotation of the throttle handle, the rotatable driving disk being coaxial with the rotatable driven disk and having cam faces situated thereon for engaging the driven pin to rotate the driven disk, the rotatable driving disk being rotatable in a high speed operation direction of rotation and in a low speed operation direction of rotation which is opposite the high speed operation direction of rotation;

a stop pin secured to the casing and engageable with the cam faces to stop the rotatable driven disk from rotating in the first direction of rotation past the first stop position and to stop the rotatable driven disk from rotating in the second direction of rotation past the second stop position, the throttle arm being in the first position and the power unit being in the state of low speed operation when the driven disk is in the first stop position, the throttle arm being in the second position and the power unit being in the state of high speed operation when the driven disk is in the second stop position; and an elastic member having a fixed end and another end secured to the rotatable driven disk to exert a force on the driven disk, the elastic member applying a biasing force to the rotatable driven disk in the first direction of rotation when the rotatable driving disk is rotated less than a first predetermined angle in the high speed operation direction of rotation, the elastic member applying a biasing force to the rotatable driven disk in the second direction of rotation opposite the first direction of rotation to cause the rotatable driven disk to move to the second stop position when the rotatable driving disk is rotated more than the first predetermined angle in the high speed operation direction of rotation.

2. The improvement according to claim 1, wherein the state of low speed operation of the power unit corresponds to an idle condition of the power unit.

3. The improvement according to claim 1, wherein the state of high speed operation of the power unit causes the power unit to operate at 10,000 rpm to 12,000 rpm.

4. The improvement according to claim 1, wherein the elastic member applies a biasing force to the rotatable driven disk in the second direction of rotation toward the second stop position when the rotatable driving disk is rotated less than a second predetermined angle in the low speed operation direction of rotation, and wherein the elastic member applies a biasing force to the rotatable driven disk in the first direction of rotation opposite the second direction of rotation to move the rotatable driven disk to the first stop position when the rotatable driving disk is rotated more than the second predetermined angle in the low speed operation direction of rotation.

5. The improvement according to claim 1, wherein the elastic member includes a spring.

* * * * *